US008157364B2

(12) United States Patent
Sasaki

(10) Patent No.: US 8,157,364 B2
(45) Date of Patent: Apr. 17, 2012

(54) INK CARTRIDGES AND INK SUPPLY SYSTEMS

(75) Inventor: Toyonori Sasaki, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 652 days.

(21) Appl. No.: 12/326,067

(22) Filed: Dec. 1, 2008

(65) Prior Publication Data

US 2009/0141105 A1 Jun. 4, 2009

(30) Foreign Application Priority Data

Nov. 30, 2007 (JP) ..... 2007-311732

(51) Int. Cl.
*B41J 2/175* (2006.01)

(52) U.S. Cl. ..... 347/86; 347/85; 347/87
(58) Field of Classification Search ..... 347/85–87
See application file for complete search history.

(56) References Cited

U.S. PATENT DOCUMENTS

| | | | | |
|---|---|---|---|---|
| 5,883,653 | A | 3/1999 | Sasaki | |
| 6,460,984 | B1 * | 10/2002 | Matsumoto et al. | 347/86 |
| 7,628,478 | B2 * | 12/2009 | Inoue | 347/85 |
| 7,712,475 | B2 * | 5/2010 | Fukuda et al. | 134/94.1 |
| 7,815,299 | B2 * | 10/2010 | Kanbe | 347/86 |
| 2006/0274129 | A1 * | 12/2006 | Lee et al. | 347/85 |
| 2007/0195140 | A1 * | 8/2007 | Ishizawa et al. | 347/86 |
| 2008/0231675 | A1 * | 9/2008 | Hattori | 347/86 |

FOREIGN PATENT DOCUMENTS

| | | | |
|---|---|---|---|
| JP | H05-318759 | A | 12/1993 |
| JP | H09-024624 | A | 1/1997 |
| JP | H09-029993 | A | 2/1997 |

* cited by examiner

*Primary Examiner* — Ellen Kim
(74) *Attorney, Agent, or Firm* — Baker Botts L.L.P.

(57) ABSTRACT

An ink cartridge includes a case having an ink chamber for storing ink, and a face that faces an exterior of the case and has a first opening formed therethrough, and a wall comprising a chamber formed therein. The wall extends from a portion of the face, and the portion surrounds the first opening. The wall supplies ink from the ink chamber to the exterior of the case via the chamber. The ink cartridge also has a cap having a second opening formed therethrough. The cap has an inner surface covering an outer surface of the wall, and a groove formed in the inner surface of the cap and extending to the second opening. The chamber is in fluid communication with the exterior of the case via the second opening.

12 Claims, 11 Drawing Sheets

INK CARTRIDGES AND INK SUPPLY SYSTEMS

CROSS-REFERENCE TO RELATED APPLICATION

The present application claims priority from Japanese Patent Application No. JP-2007-311732, which was filed on Nov. 30, 2007, the disclosure of which is incorporated herein by reference in its entirety.

BACKGROUND OF THE INVENTION

1. Field of the Invention

The present invention relates generally to ink cartridges and ink supply systems configured to be used in an image recording apparatus. More specifically, the present invention relates to ink cartridges comprising a cap having a groove formed therein, and ink supply systems comprising such an ink cartridge.

2. Description of Related Art

A known ink-jet image recording apparatus has a recording head and an ink supply device configured to supply ink to the recording head. A known ink cartridge is configured to be mounted to the ink supply device. The known ink cartridge has a case, and the case has an ink chamber formed therein. The known ink chamber is configured to store ink therein. A wall of the case has an opening formed therethrough, and ink is supplied from an interior of the ink chamber to an exterior of the ink chamber via the opening. When the ink cartridge is mounted to the ink supply device, ink stored in the ink chamber is supplied to the recording head via the opening. The recording head is configured to selectively eject ink toward a sheet of paper, such that an image is recorded on the sheet.

When the known ink cartridge is mounted to and removed from the ink supply device, ink may leak from the opening. Another known ink cartridge, such as the ink cartridge described in JP-A-9-29993, has means for holding ink, which has leaked from the opening, adjacent to the opening. More specifically, the another known ink cartridge has a plurality of depressions and protrusions around the opening. Capillary force holds the ink, which has leaked from the opening, in the gaps formed between the plurality of depressions and protrusions.

Nevertheless, when the another known ink cartridge is repeatedly mounted to and removed from the ink supply device, the ink held in the gaps formed between the plurality of depressions and protrusions may turn into a relatively large ink droplet, and such an ink droplet may drip from the ink cartridge.

SUMMARY OF THE INVENTION

Therefore, a need has arisen for ink cartridges and ink supply systems which overcome these and other shortcomings of the related art. A technical advantage of the present invention is that ink is prevented from dropping from an ink cartridge as an ink droplet.

In an embodiment of the invention, an ink cartridge comprises a case comprising an ink chamber configured to store ink therein, a particular face that faces an exterior of the case and has a first opening formed therethrough, and a particular wall comprising a particular chamber formed therein. The particular wall extends from a particular portion of the particular face, and the particular portion surrounds the first opening. The particular wall is configured to supply ink from the ink chamber to the exterior of the case via the particular chamber. The ink cartridge also comprises a cap having a second opening formed therethrough. The cap comprises a particular inner surface covering an outer surface of the particular wall, and a particular groove formed in the particular inner surface of the cap and extending to the second opening, wherein the particular chamber is configured to be in fluid communication with the exterior of the case via the second opening.

In another embodiment of the invention, an ink cartridge comprises a case comprising an ink chamber configured to store ink therein, a first face facing an exterior of the case and having a first opening formed therethrough, a second face facing the exterior of the case and positioned opposite the first face, a third face facing the exterior of the case and extending between the first face and the second face, a fourth face facing the exterior of the case and extending between the first face and the second face, wherein the fourth face is positioned opposite the third face, and the first opening is positioned closer to the fourth face than to the third face, and a particular wall having a particular chamber formed therein. The particular wall extends from a particular portion of the particular face, and the particular portion surrounds the first opening, wherein the particular wall is configured to supply ink from the ink chamber to the exterior of the case via the particular chamber. The ink cartridge also comprises a cap comprising a particular inner surface covering an outer surface of the particular wall, and a particular groove formed in the particular inner surface of the cap. The cap has a second opening formed therethrough, and the particular chamber is configured to be in fluid communication with the exterior of the case via the second opening. The particular groove extends to the second opening, and the particular groove is positioned between the particular wall and a plane on which the fourth face lies.

In yet another embodiment of the invention, an ink supply system comprises a particular tube and an ink cartridge. The ink cartridge comprises a case, which comprises an ink chamber configured to store ink therein, a particular face that faces an exterior of the case and has a first opening formed therethrough, and a particular wall comprising a particular chamber formed therein. The particular wall extends from a particular portion of the particular face, and the particular portion surrounds the first opening. The particular wall is configured to supply ink from the ink chamber to the exterior of the case via the particular chamber. The ink cartridge also comprises a cap having a second opening formed therethrough. The cap comprises a particular inner surface covering an outer surface of the particular wall, and a particular groove formed in the particular inner surface of the cap, and extending to the second opening. The particular chamber is configured to be in fluid communication with the exterior of the case via the second opening. The ink cartridge also comprises an elastic member positioned at an end of the particular wall opposite the first opening, wherein the elastic member has a third opening formed therethrough, and the particular chamber is configured to be in fluid communication with the exterior of the case via the second opening and the third opening. The particular tube is configured to be inserted into the second opening and the third opening, and an outer diameter of the particular tube is less than a diameter of the second opening, and the outer diameter of the particular tube is greater than a diameter of the third opening.

Other objects, features, and advantages of embodiments of the present invention will be apparent to persons of ordinary skill in the art from the following description of embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Figure 1B:
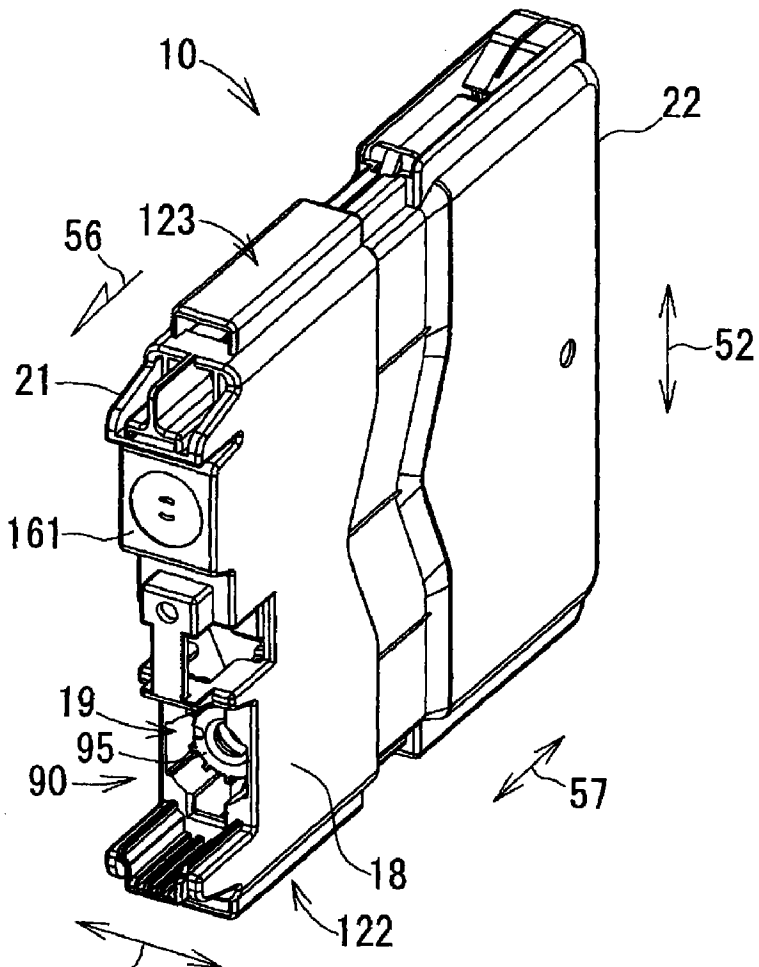
FIGS. 1(A) and 1(B) are perspective views of an ink cartridge in which a first cover of the ink cartridge is in a second position and in a first position, respectively, according to an embodiment of the invention.

Embodiments of the invention and their features and technical advantages may be understood by referring to FIGS. 1 to 11, like numerals being used for like corresponding portions in the various drawings.

Referring to FIGS. 1(A) to 4, an ink cartridge 10 according to an embodiment of the invention is described. Ink cartridge 10 may be configured to be used with an ink-jet image recording apparatus (not shown). The ink-jet image recording apparatus may comprise a recording head (not shown) and an ink supply device configured to supply ink to the recording head (not shown). The ink supply device may comprise a mounting portion (not shown), and ink cartridge 10 may be configured to be removably mounted to the mounting portion.

Ink cartridge 10 may have a flattened, substantially rectangular parallelepiped shape having a width in a width direction 51, a height in a height direction 52, and a depth in a depth direction 57. The width of ink cartridge 10 may be less than each of the height of ink cartridge 10 and the depth of ink cartridge 10. Ink cartridge 10 may comprise a top face 123 and a bottom face 122 opposite top face 123. Ink cartridge 10 may be inserted into the mounting portion in an insertion direction 56, which is parallel to depth direction 57. When ink cartridge 10 is mounted to the mounting portion, ink cartridge 10 may be positioned as depicted in FIGS. 1(A) to 2(B), e.g., top face 123 may be positioned at the top of ink cartridge 10, and bottom face 122 may be positioned at the bottom of ink cartridge 10.

Ink cartridge 10 may comprise a case 20, a first cover 21, a second cover 22, and coil springs 23 and 24. First cover 21 and second cover 22 substantially may define the outer appearance of ink cartridge 10. Case 20 may comprise an ink chamber 100 formed therein, and ink chamber 100 may be configured to store ink therein. First cover 21 and second cover 22 substantially may enclose case 20. In an embodiment, case 20, first cover 21, and second cover 22 may comprise a resin material, e.g., nylon, polyethylene, polypropylene, or any combination thereof.

Figure 3:
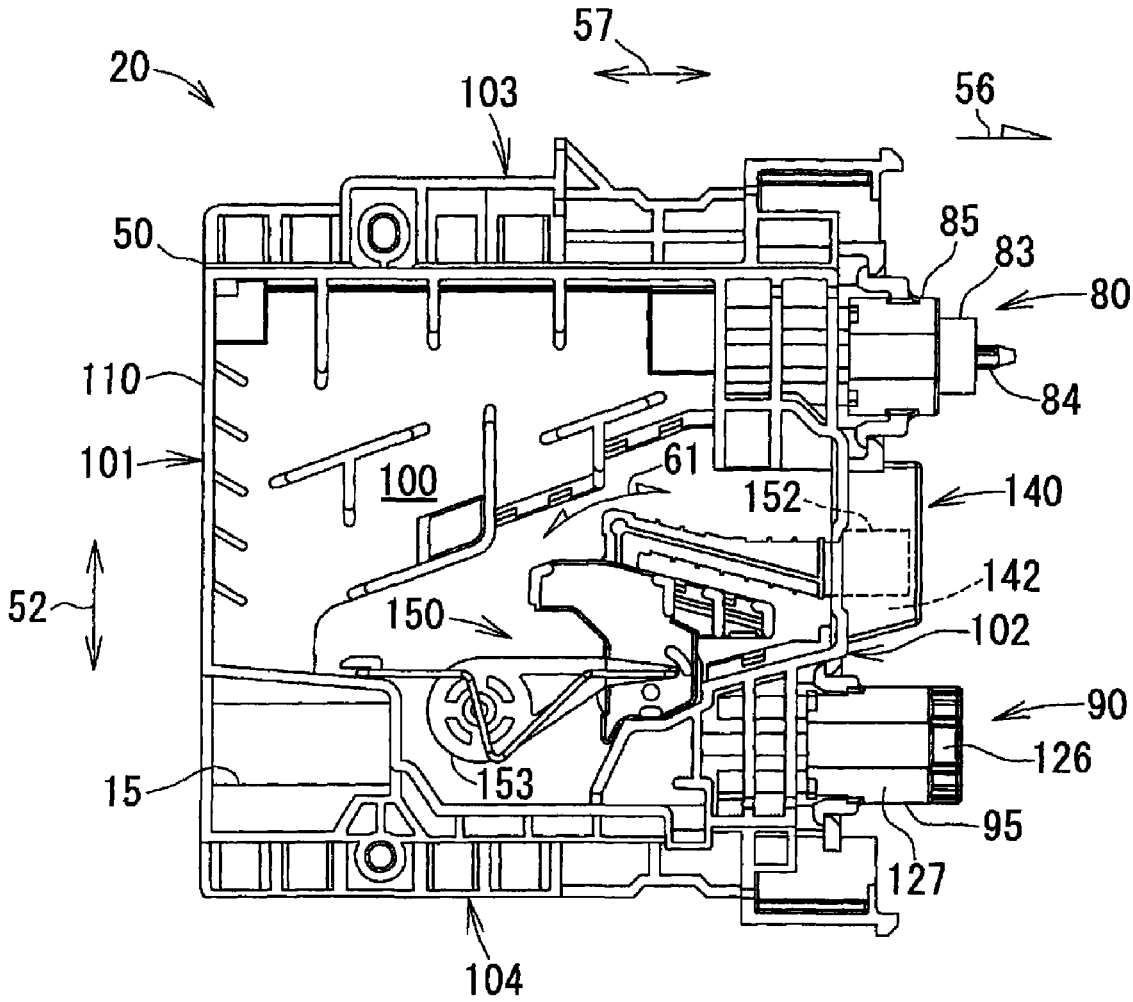
FIG. 3 is a side view a case of the ink cartridge of FIGS. 1(A) and 1(B).
Figure 4:
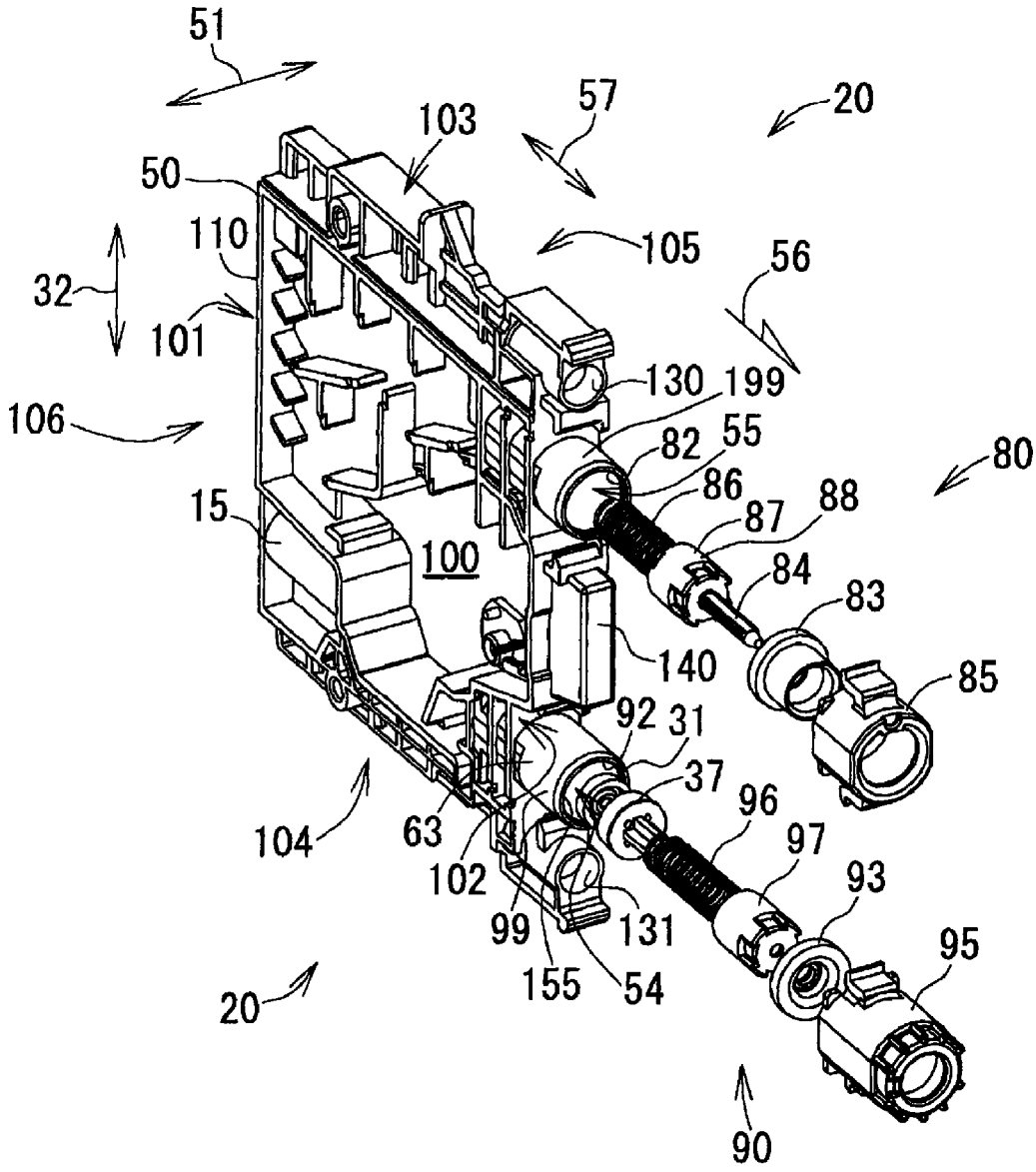
FIG. 4 is an exploded, perspective view of the case of FIG. 3, in which a pivotable member is omitted.

Referring to FIGS. 3 and 4, case 20 may comprise a front face 102, a rear face 101 positioned opposite front wall 102, a top face 103 extending between front face 102 and rear face 101, a bottom face 104 extending between front face 102 and rear face 101 and positioned opposite top face 103, a left face 105 extending between front face 102 and rear face 101, and a right face 106 extending between front face 102 and rear face 101 and positioned opposite left face 105. Each of front face 102, rear face 101, top face 103, bottom face 104, left face 105, and right face 106 may face the exterior of case 20, and may define the outer appearance of case 20. When ink cartridge 10 is inserted into the mounting portion, case 20 may be inserted from a front face 102 side.

When the ink cartridge 10 is mounted to the mounting portion and is used in the image recording apparatus, top face 103 may be positioned at the top of case 20 and bottom face 104 may be positioned at the bottom of case 20. Each of an area of left face 105 and an area of right face 106 may be greater than each of an area of front face 102, an area of rear face 101, an area of top face 103, and an area of bottom face 104. Ink cartridge 10 further may comprise an air communication valve mechanism 80, an ink supply valve mechanism 90, and a pivotable member 150.

Case 20 may comprise a frame 110 and one or more, e.g., a pair of films (not shown). Frame 110 may comprise front face 102, rear face 101, top face 103, and bottom face 104. The pair of films may comprise left face 105 and right face 106. Frame 110 also may comprise a translucent resin material, e.g., a transparent or semi-transparent resin material, such as polyacetal, nylon, polyethylene, polypropylene, or the like, and may be manufactured by injection molding the resin material.

Frame 110 may have a substantially rectangular profile extending along front face 102, top face 103, rear face 101, and bottom face 104, forming a space inside. As a result, a pair of openings may be formed at widthwise ends of the frame 110, respectively. The pair of films may be attached, e.g., welded or bonded with adhesive, to the widthwise ends of frame 110, respectively, such that the pair of openings may be covered by the pair of films, respectively. Frame 110 and the pair of films may define an ink chamber 100 therein. Ink chamber 100 may be configured to store ink therein. In another embodiment, a frame may be a container having six rigid walls, and an ink chamber may be formed in the container.

Referring to FIGS. 3 and 4, frame 110 may comprise an ink filling portion 15 positioned at rear face 101. Ink filling portion 15 may comprise a substantially circular, cylindrical chamber extending from rear surface 101 toward ink chamber 100. The cylindrical chamber of ink filling portion 15 may be configured to be in fluid communication with ink chamber 100. When ink cartridge 10 is manufactured, ink may be introduced into ink chamber 100 via ink filling portion 15, such that ink chamber 100 is filled with ink.

Case 20 may comprise a detection portion 140 extending from front face 102, away from ink chamber 100. The amount of ink stored in ink chamber 100 may be visually or optically detected via detection portion 140. Detection portion 140 may be integral with frame 110. Therefore, detection portion 140 may comprise the same material as frame 110, e.g., a translucent resin material, e.g., a transparent or semi-transparent resin material. Light may pass through detection portion 140. When ink cartridge 10 is mounted to the mounting portion, detection portion 140 may be irradiated with light emitted from an optical sensor, e.g., a photo-interrupter, positioned in the mounting portion. Detection portion 140 may have an inner space 142 formed therein, which may be continuous with ink chamber 100.

Pivotable member 150 may be positioned in ink chamber 100. Pivotable member 150 may comprise an indicator portion 152 at one end of pivotable member 150. Indicator portion 152 may be positioned in inner space 142 and configured to move in inner space 142. Pivotable member 150 may comprise a float portion 153 at another end of pivotable member 150. Pivotable member 150 may be pivotably supported by case 20 at a position between indicator portion 152 and float portion 153, such that pivotable member 150 may pivot in a direction indicated by an arrow 61 in FIG. 3. The specific gravity of float portion 153 may be less than the specific gravity of ink stored in ink chamber 100. For example, float portion 153 may comprise a hollow body formed therein, such that the specific gravity of float portion 153 is less than the specific gravity of ink stored in ink chamber 100. Therefore, float portion 153 may be configured to float on a surface of the ink in ink chamber 100, and float portion 153 may move up and down according to an increase or a decrease of the amount of ink in ink chamber 100.

Pivotable member 150 may pivot in accordance with the movement of float portion 153, and indicator portion 152 may move in inner space 142 in accordance with the pivotal movement of pivotable member 150. The position of indicator portion 152 in inner space 142 may be detected by the optical sensor, or detected visually, from the exterior of detection portion 140. Based on the detection of the position of indicator portion 152, a determination may be made whether the amount of ink in ink chamber 100 is greater than or equal to a predetermined amount.

Referring to FIGS. 1(A) to 2(B), first cover 21 may have a container shape, and may accommodate a front portion of case 20 with respect to insertion direction 56, e.g., first cover 21 may accommodate front face 102 side of case 20. Second cover 22 may have a container shape and may accommodate a rear portion of case 20 with respect to insertion direction 56, e.g., second cover 22 may accommodate rear face 101 side of case 20. Accordingly, the front portion of case 20 may be protected by first cover 21, and the rear portion of case 20 may be protected by second cover.

Figure 1A:
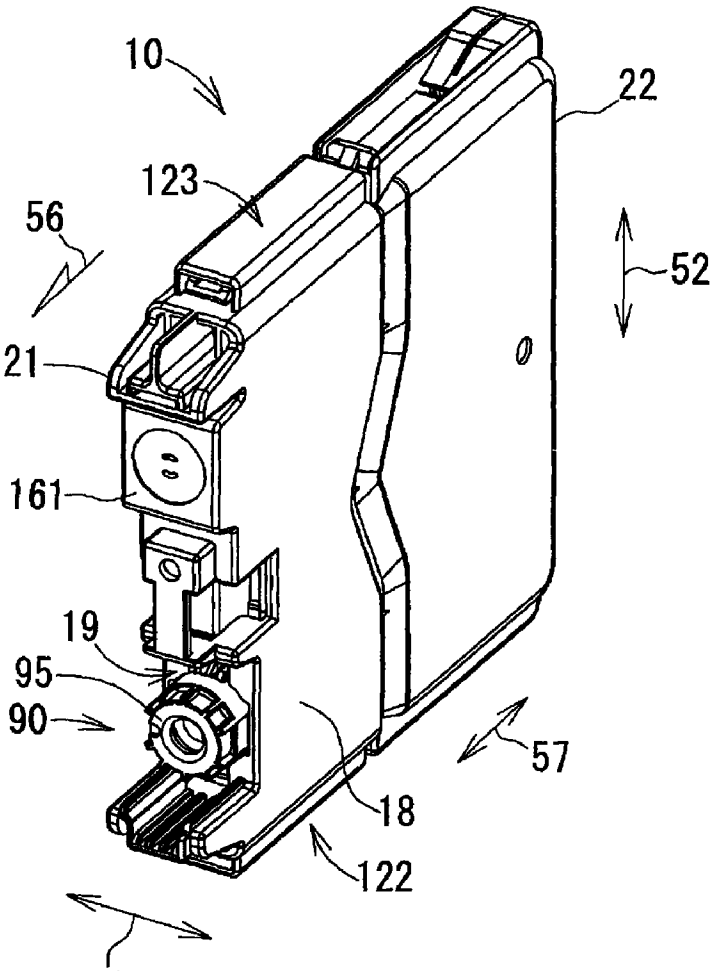
Figure 2A:
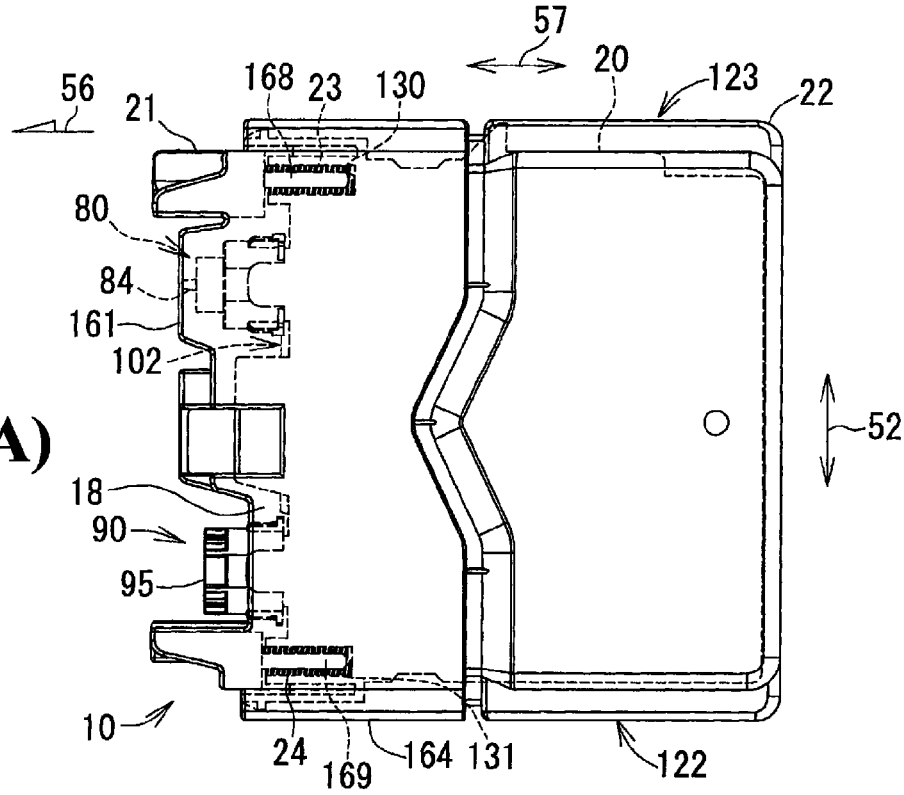
FIGS. 2(A) and 2(B) are side views of the ink cartridge of FIGS. 1(A) and 1(B), respectively.
Figure 2B:
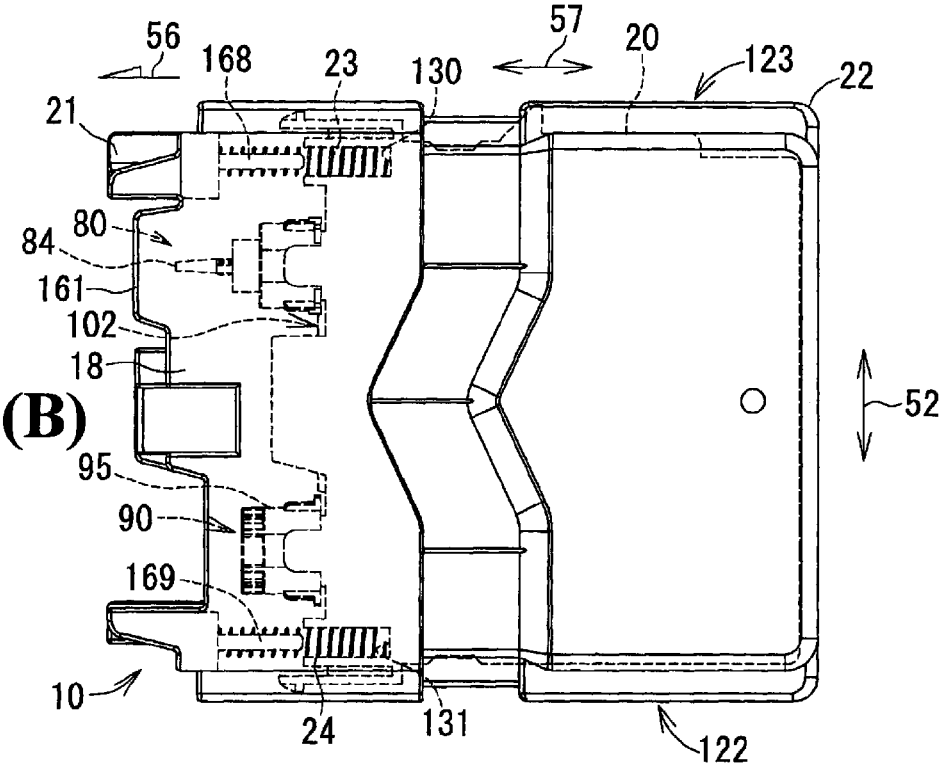

First cover 21 may comprise a front wall 161 facing front face 102 of case 20, and an opening 19 may be formed through front wall 161. First cover 21 may be configured to slide in depth direction 57 with respect to second cover 22. FIGS. 1(B) and 2(B) show first cover 21 in a first position, in which front wall 161 is positioned at a far end away from front face 102 of case 20, within the sliding range of first cover 21. FIGS. 1(A) and 2(A) show first cover 21 in a second position, in which front wall 161 is positioned at a close end to front face 102 of case 20, within the sliding range of first cover 21.

Referring to FIGS. 2(A) and 2(B), first cover 21 may comprise supporting bars 168 and 169 positioned at a surface of the front wall 161, facing front face 102 of case 20. Case 20 may comprise spring chambers 130 and 131 formed in front face 102. Spring chambers 130 and 131 may be positioned adjacent to top face 103 and bottom face 104, respectively. Coil springs 23 and 24 may be accommodated in spring chambers 130 and 131, respectively, and supporting bars 168 and 169 may be inserted into coil springs 23 and 24, respectively. Coil springs 23 and 24 may apply a biasing force to first cover 21 to bias first cover 21 toward the first position. Accordingly, when no external force is applied to first cover 21, first cover 21 may be in the first position. When an external force is applied to first cover 21 against the biasing force of coil springs 23 and 24, first cover 21 may move from the first position to the second position.

Figure 5:
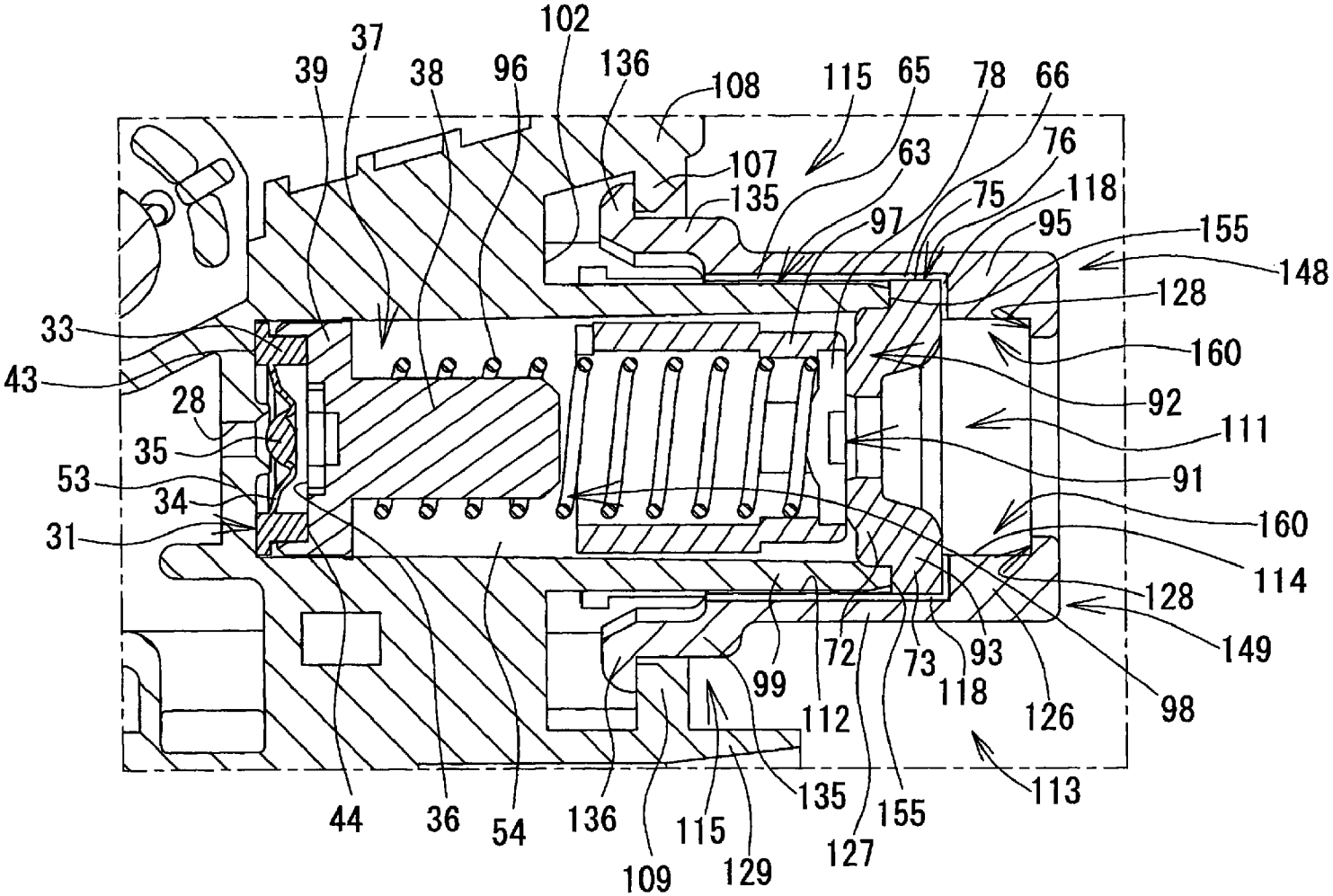
FIG. 5 is a partial, cross-sectional view of the case of FIG. 3, showing a structure adjacent to an ink supply wall of the case, in which an ink supply opening is covered, and a plurality of second grooves are omitted.

Referring to FIG. 5, an opening 98 may be formed through front face 102 of case 20. Opening 98 may be positioned closer to bottom face 104 than to top face 103. Referring to FIGS. 4 and 5, case 20 may comprise an ink supply wall 99 extending from a particular portion of front face 102 which surrounds opening 98. Ink supply wall 99 may extend toward the exterior of case 20 in depth direction 57. In an embodiment of the invention, ink supply wall 99 may have a tube shape, e.g., a substantially circular, cylindrical tube shape. In another embodiment, ink supply wall 99 may have a substantially rectangular, cylindrical tube shape. Referring to FIG. 5, a valve chamber 54 may be formed in ink supply wall 99, and valve chamber 54 may extend from the interior of ink supply wall 99 to the interior of case 20 beyond front face 102 via opening 98. Valve chamber 54 may extend in depth direction 57. In an embodiment, valve chamber 54 may have a substantially circular, cylindrical shape. Case 20 may comprise an end wall 53 defining the inner end of valve chamber 54, and an opening 28 may be formed through end wall 53. Valve chamber 54 may be configured to be in fluid communication with ink chamber 100 via opening 28, and at least a portion of ink supply valve mechanism 90 may be accommodated in valve chamber 54.

Referring to FIGS. 4 and 5, an opening 92 may be formed at an end 155 of ink supply wall 99 opposite opening 98. Ink supply valve mechanism 90 may be configured to selectively allow and prevent fluid communication between the interior of ink chamber 100 and the exterior of case 20 via opening 92 and valve chamber 54. Ink supply valve mechanism 90 may comprise a first valve element 31, a valve seat 37, a coil spring 96, a second valve element 97, a sealing member 93, and a cap 95. Each of first valve element 31, valve seat 37, coil spring 96, second valve element 97, sealing member 93, and cap 95 may comprise a resin, e.g., polyacetal or silicon rubber.

First valve element 31, valve seat 37, coil spring 96, second valve element 97, sealing member 93, and cap 95 may be sequentially aligned in the listed order in the depth direction 57, and may contact each other. First valve element 31, valve seat 37, coil spring 96, and second valve element 97 may be accommodated in valve chamber 54. Sealing member 93 and cap 95 may be positioned at end 155 of ink supply wall 99.

Figure 6:
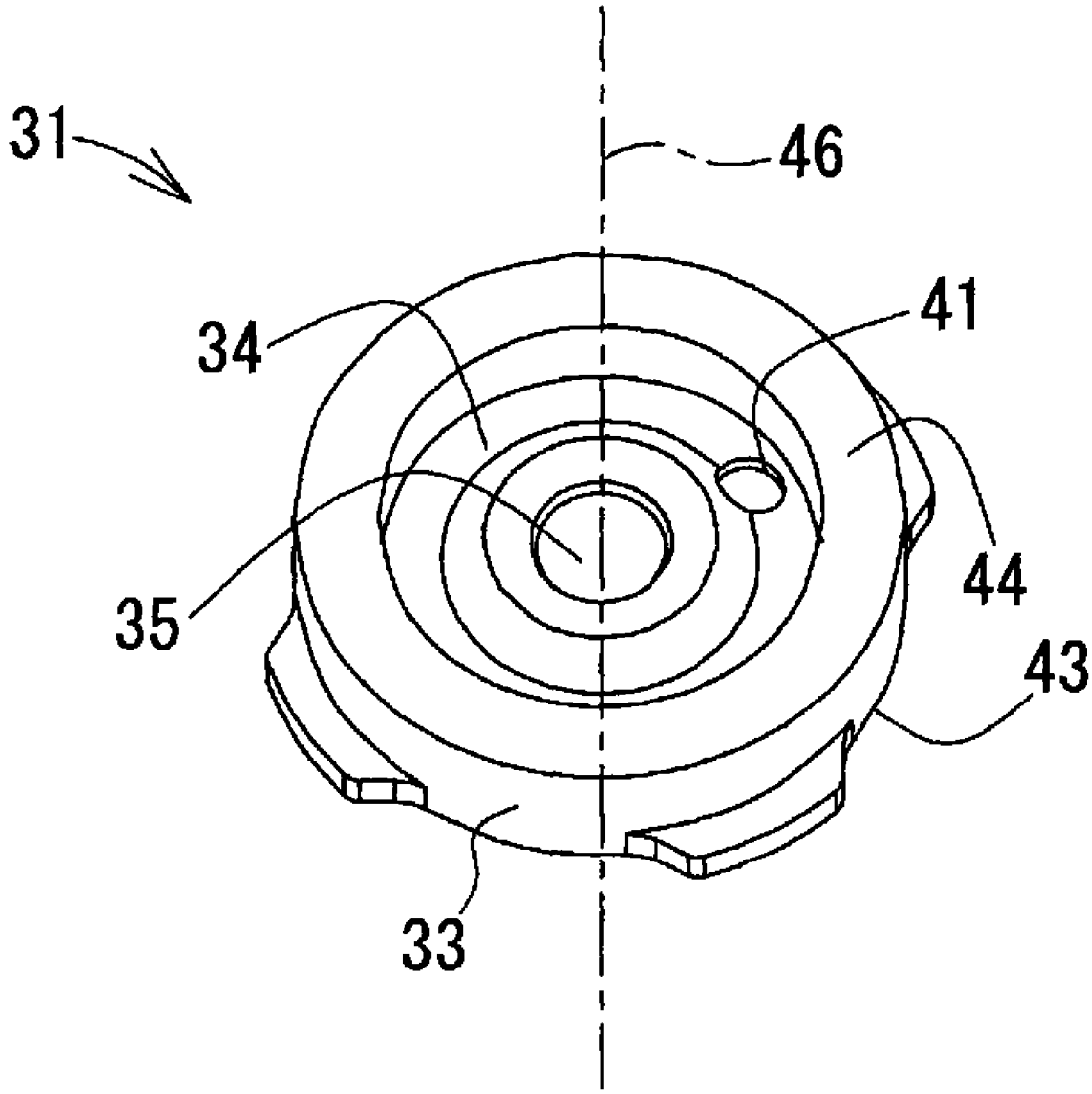
FIG. 6 is a perspective view of a first valve element, according to an embodiment of the invention.
Figure 7:
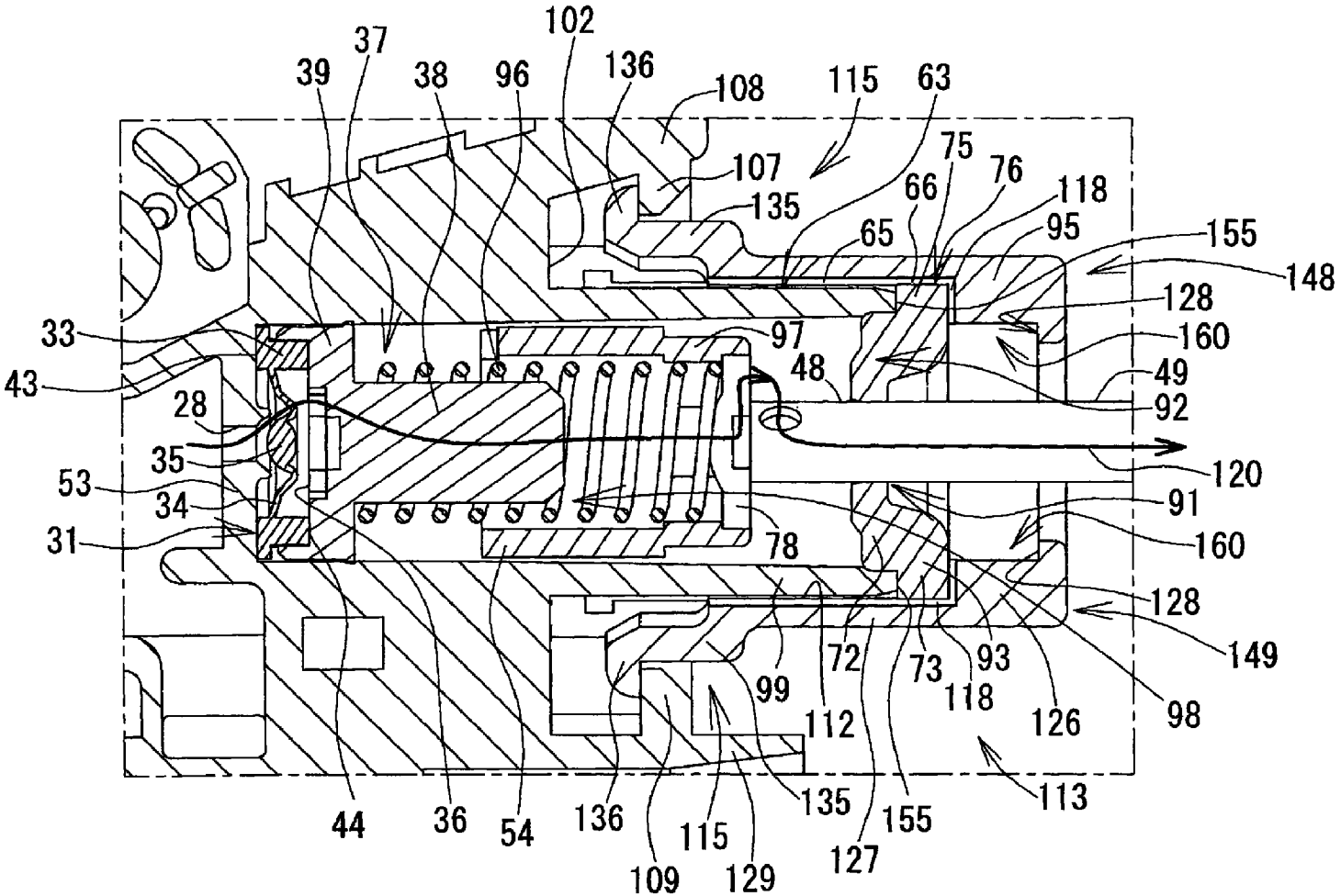
FIG. 7 is a partial, cross-sectional view of the case of FIG. 3, showing a structure adjacent to the ink supply wall of the case, in which the ink supply opening is uncovered, and the second grooves are omitted.

Referring to FIGS. 5 and 6, first valve element 31 may comprise a first side 43 and a second side 44 opposite first side 43. First valve element 31 may be positioned in valve chamber 54, such that first side 43 contacts end wall 53 and second side 44 contacts valve seat 37. First valve element 31 may be configured to selectively cover and uncover opening 28 formed through end wall 53. First valve element 31 may be manufactured by injection-molding silicon rubber. First valve element 31 may comprise a circular, cylindrical member 33, an inner wall 34, and a lid member 35. Circular, cylindrical member 33 may receive a biasing force from coil spring 96 via valve seat 37. The biasing force may bring circular, cylindrical member 33 into contact with end wall 53. Inner wall 34 may extend in a direction intersecting a center line 46 of circular, cylindrical member 33 inside circular, cylindrical member 33. Center line 46 may be parallel to depth direction 57.

Inner wall 34 may be bent when viewed in a cross sectional view. In an embodiment, inner wall 34 may be a thin wall comprising silicon rubber, such that inner wall 34 may be flexible. Inner wall 34 readily may be deformed when inner wall 34 receives pressure from ink. An opening 41 may be formed through inner wall 34 in a direction substantially parallel to center line 46. Ink may pass through opening 41 when ink flows from ink chamber 100 into valve chamber 54. Lid member 35 may be positioned at the center of inner wall 34. Lid member 35 may be configured to selectively cover and uncover opening 28 of end wall 53. In an embodiment, lid member 35 may have a substantially spherical shape.

Valve seat 37 may be manufactured by injection-molding polypropylene resin. Valve seat 37 may comprise a valve seat base portion 38 and a valve element receiving portion 39. Valve seat base portion 38 may have a circular, cylindrical rod shape extending from the center of a circular surface of valve element receiving portion 39 in depth direction 57. The outer diameter of the valve seat base portion 38 may be slightly smaller than the inner diameter of the coil spring 96. Valve seat base portion 38 may be inserted into coil spring 96. Accordingly, coil spring 96 may be supported by the valve seat base portion 38, such that coil spring 96 is configured to expand and contract in the direction in which valve seat base portion 38 extends, e.g., in depth direction 57. An end of coil spring 96 may contact the circular surface of valve element receiving portion 39.

Valve element receiving portion 39 may have a substantially circular, cylindrical shape, and may receive and contact first valve element 31. The outer diameter of valve element receiving portion 39 may be less than the diameter of valve chamber 54. Valve element receiving portion 39 may have a substantially circular, cylindrical recess 36 formed therein, and first valve element 31 may be fitted in recess 36. The diameter of recess 36 may be greater than the outer diameter of circular, cylindrical member 33 of first valve element 31. The depth of recess 36 may be substantially equal to the thickness of circular, cylindrical member 33 in a direction parallel to center line 46, e.g., in depth direction 57. An opening may be formed through a bottom surface of recess 36, such that ink may pass therethrough. Valve seat 37 may press circular, cylindrical member 33 of first valve element 31 toward end wall 53 upon reception of the biasing force of coil spring 96.

When ink in valve chamber 54 flows toward ink chamber 100, the ink may press inner wall 34 of first valve element 31, such that inner wall 34 deforms to move lid member 35 toward opening 28. When lid member 35 contacts end wall 53 and covers opening 28, ink may be prevented from flowing from valve chamber 54 to ink chamber 100. When ink in ink chamber 100 flows into valve chamber 54, the ink may flow through opening 28 and press inner wall 34, such that inner wall 34 deforms to move lid member 35 away from end wall 53. Accordingly, opening 28 may be uncovered, and ink may flow from ink chamber 100 via opening 28, opening 41, and the opening formed through the bottom surface of recess 36 into valve chamber 54.

Referring to FIG. 5, second valve element 97 may be configured to move in depth direction 57. Second valve element 97 may comprise a wall 78 configured to contact sealing member 93. Coil spring 96 may be positioned between valve element receiving portion 39 of valve seat 37 and wall 78 of second valve element 97 while being compressed. Coil spring 96 may bias valve element receiving portion 39, such that circular, cylindrical member 33 of first valve element 31 contacts end wall 53 tightly. Coil spring 96 may bias second valve element 97 toward sealing member 93, such that wall 78 of second valve element 97 may contact sealing member 93.

Sealing member 93 may comprise elastic material, e.g., rubber, and sealing member 93 may be configured to elastically deform. Sealing member 93 may comprise a first circular, cylindrical portion 72 fitted into valve chamber 54 via opening 92, and a second circular, cylindrical portion 73 which may be in contact with end 155 of ink supply wall 99 defining opening 92. The outer diameter of first circular, cylindrical portion 72 may be substantially equal to the diameter of valve chamber 54. The outer diameter of second circular, cylindrical portion 73 may be greater than the diameter of valve chamber 54, and may be substantially equal to the inner diameter of an inner surface 112 of cap 95. Cap 95 may be attached to case 20, such that cap 95 presses sealing member 93 against end 155 of ink supply wall 99 defining opening 92. Accordingly, sealing member 93 may elastically deform and contact end 155 of ink supply wall 99, to form a liquid-tight seal. Moreover, because second circular, cylindrical portion 73 is pressed between cap 95 and end 155 of ink supply wall 99, second circular, cylindrical portion 73 may elastically expand, such that the diameter thereof increases. Accordingly, an outer surface 76 of second circular, cylindrical portion 73 may contact inner surface 112 of cap 95, to form a liquid-tight seal.

An ink supply opening 91 may be formed through the center of first circular, cylindrical portion 72 and the center of second circular, cylindrical portion 73. Opening 91 may have a substantially circular conical shape. Coil spring 96 may bias second valve element 97 toward sealing member 93, such that wall 78 of second valve element 97 contacts sealing member 93 and covers opening 91. When wall 78 of second valve element 97 contacts sealing member 93 and covers opening 91, fluid communication between the interior of ink chamber 100 and the exterior of case 20 via opening 91 and valve chamber 54 may be prevented. When an external force is applied to second valve element 97 against the biasing force of coil spring 96, second valve element 97 may move away from sealing member 93, and opening 91 may be uncovered. Consequently, the interior of ink chamber 100 and the exterior of case 20 may be placed in fluid communication via opening 91 and valve chamber 54.

Referring to FIGS. 8(A) to 10, cap 95 may comprise a cap body 113 and engaging members 115. Cap body 113 may comprise an end wall 125, a first side wall 126, and a second side wall 127. End wall 125 may have a disk shape, and may define an end of cap 95. An opening 111 may be formed through end wall 125 and first side wall 126. Opening 111, valve chamber 54, and ink supply opening 91 may be sequentially aligned in depth direction 57.

First side wall 126 may extend from a peripheral edge of end wall 125. First side wall 126 may comprise an outer surface having a substantially circular, cylindrical shape, and an inner surface 114 having a substantially circular, cylindrical shape. Inner surface 114 of first side wall 126 may define a portion of opening 111. The outer diameter of first side wall 126 may be less than the outer diameter of second side wall 127, and the inner diameter of first side wall 126 may be less than the diameter of valve chamber 54. The thickness of the first side wall 126 may be greater than the thickness of second side wall 127 in the radial direction of cap body 113, e.g., the direction perpendicular to depth direction 57.

Cap 95 may comprise a plurality of, e.g., ten, ribs 124 on the outer surface of first side wall 126. The ribs 124 may be sequentially aligned in the circumferential direction of first side wall 126 at a predetermined interval. Ribs 124 may extend outward from the outer surface of the first side wall 126 in radial directions of first side wall 126, which is perpendicular to depth direction 57, and may extend in the axial direction of first side wall 126, e.g., parallel to depth direction 57, e.g., the direction vertical to the plane of the paper in FIG. 9. Referring to FIG. 8(A), ends of ribs 124 may be flush with an outer surface of second side wall 127, and ribs 124 may be connected to second side wall 127. Ribs 124 may reinforce the rigidity of end wall 125, first side wall 126, and second side wall 127.

Second side wall 127 may be connected to the first side wall 126, and may comprise an outer surface having a substantially circular, cylindrical shape, and inner surface 112 having a substantially circular, cylindrical shape. The inner diameter of second side wall 127 may be substantially equal to the outer diameter of ink supply wall 99 and the outer diameter of second circular, cylindrical portion 73 of sealing member 93. An outer surface 63 of ink supply wall 99 and outer surface 76 of second circular, cylindrical portion 73 of sealing member 93 may be covered by second side wall 127. Sealing member 93 may be pressed by first side wall 126 of cap 95, and may elastically deform, thereby increasing the diameter of sealing member 93. Accordingly, outer surface 76 of second circular, cylindrical portion 73 of sealing member 93 may contact inner surface 112 of second side wall 127, to create a fluid-tight seal.

Referring to FIGS. 8(A) to 10, engaging members 115 may extend from the outer surface of second side wall 127. In an embodiment, two engaging members 115 may be positioned at two positions on the outer surface of second side wall 127, respectively, such that the center axis of second side wall 127 may be positioned between engaging members 115. Engaging members 115 each may comprise an elastically deforming portion 135 and a hook portion 136. Elastically deforming portion 135 may have a substantially L-shape extending outward from the outer surface of second side wall 127 in the radial direction of second side wall 127, e.g., the direction perpendicular to depth direction 57, and then extending toward an end 138 of the cap 95, which is opposite from end wall 125, in the axial direction of second side wall 127, e.g., the direction parallel to depth direction 57. Hook portion 136 may extend outward in the radial direction of second side wall 127 from an end of elastically deforming portion 135. Elastically deforming portion 135 may be configured to elastically deform. Specifically, elastically deforming portion 135 may bend with respect to the outer surface of second side wall 127, such that hook portion 136 may move outward and inward, in the radial direction of second side wall 127.

Figure 9:
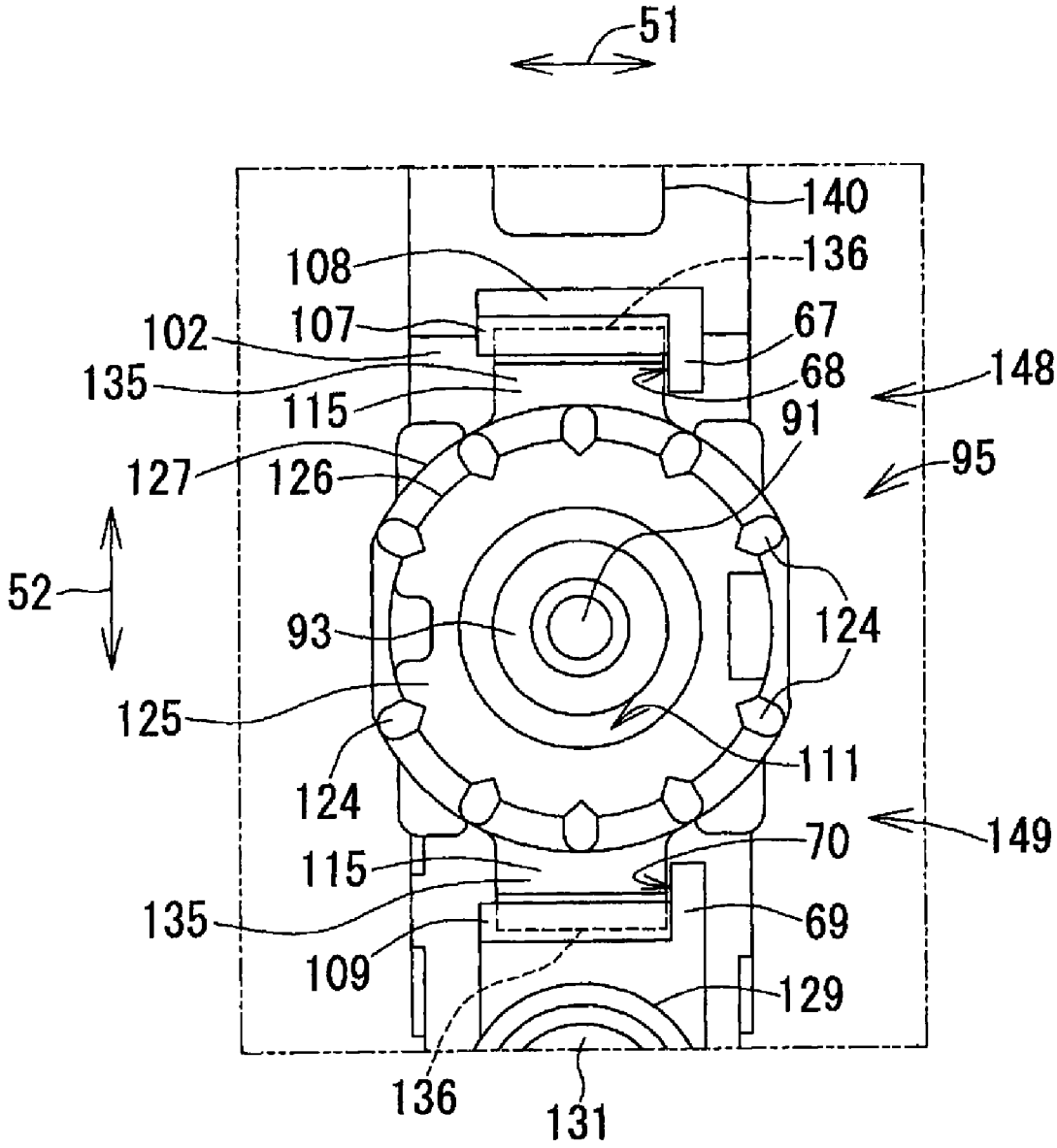
FIG. 9 is a partial, front view of the case of FIG. 3, showing a structure adjacent to the cap of FIGS. 8(A) and 8(B).

Referring to FIGS. 5 and 9, case 20 may comprise engaged portions 107 and 109 at front face 102 at positions corresponding to hook portions 136 of cap 95, respectively. Hook portions 136 may engage engaged portions 107 and 109, respectively. Engaged portion 107 may extend toward bottom face 104 and toward outer surface 63 of ink supply wall 99 from a wall 108 extending from front face 102. Engaged portion 109 may extend toward top face 102 and toward outer surface 63 of ink supply wall 99 from an outer surface of a circular, cylindrical wall 129, thereby defining spring chamber 131 therein.

Referring to FIG. 9, case 20 may comprise guide members 67 and 69 positioned adjacent to engaged portions 107 and 109, respectively. Guide members 67 and 69 may be configured to guide engaging members 115 toward the engaged portions 107 and 109, respectively, when cap 95 is attached to case 20 during the manufacture of ink cartridge 10. Guide members 67 and 69 may be positioned outward from front face 102 than engaged portions 107 and 109 are positioned. Guide members 67 and 69 may comprise guide surfaces 68 and 70 configured to contact elastically deforming portions 135 and hook portions 136.

Referring to FIGS. 5 and 9, when ink cartridge 10 is manufactured, cap 95 may be attached to case 20, such that end 138 of cap 95 faces case 20. Hook portions 136 may be brought into contact with engaged portions 107 and 109. Subsequently, when cap 95 is pressed toward front face 102, hook portions 136 may be pressed against engaged portions 107 and 109. When hook portions 136 press against engaged portions 107 and 109, elastically deforming portions 135 may elastically deform toward outer surface 63 of ink supply wall 99, and hook portions 136 may move over engaged portions 107 and 109.

When cap 95 is further pressed toward front face 102, such that engaged portions 107 and 109 no longer outwardly deform hook portions 136, hook portions 136 may return to their original positions due to the elasticity of the elastically deforming portions 135, such that hook portions 136 and engaged portions 107 and 109 are engaged. Accordingly, referring to FIGS. 5 and 9, cap 95 may be attached to case 20, such that ink supply wall 99 may be positioned between engaging members 115 in height direction 52. One of engaging members 115 may be positioned in a position 148 between ink supply wall 99 and top face 103, and the other of engaging member 115 may be positioned in a position 149 between ink supply wall 99 and bottom wall 104.

Figure 10:
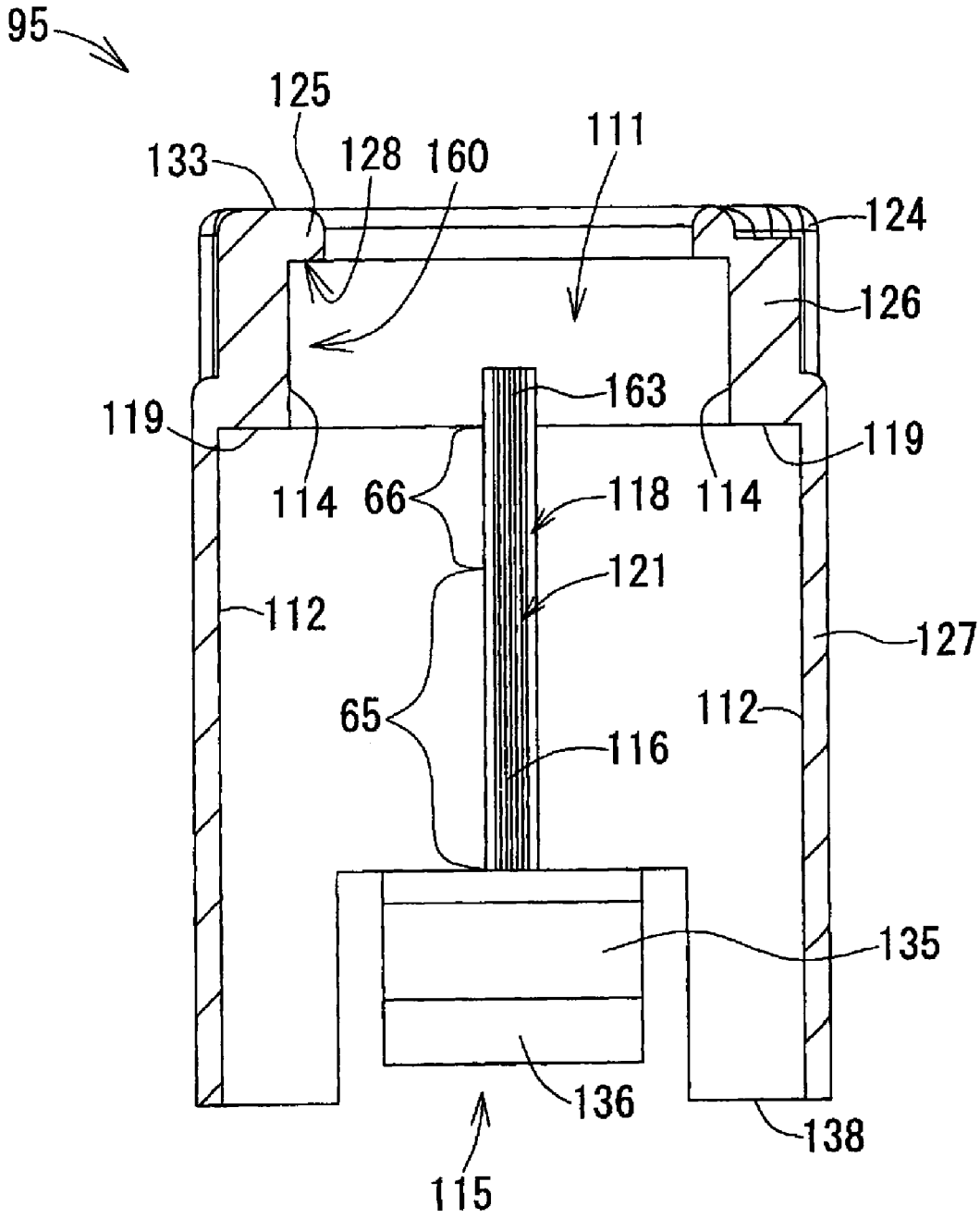
FIG. 10 is a cross-sectional view of the cap of FIGS. 8(A) and 8(B).
Figure 11:
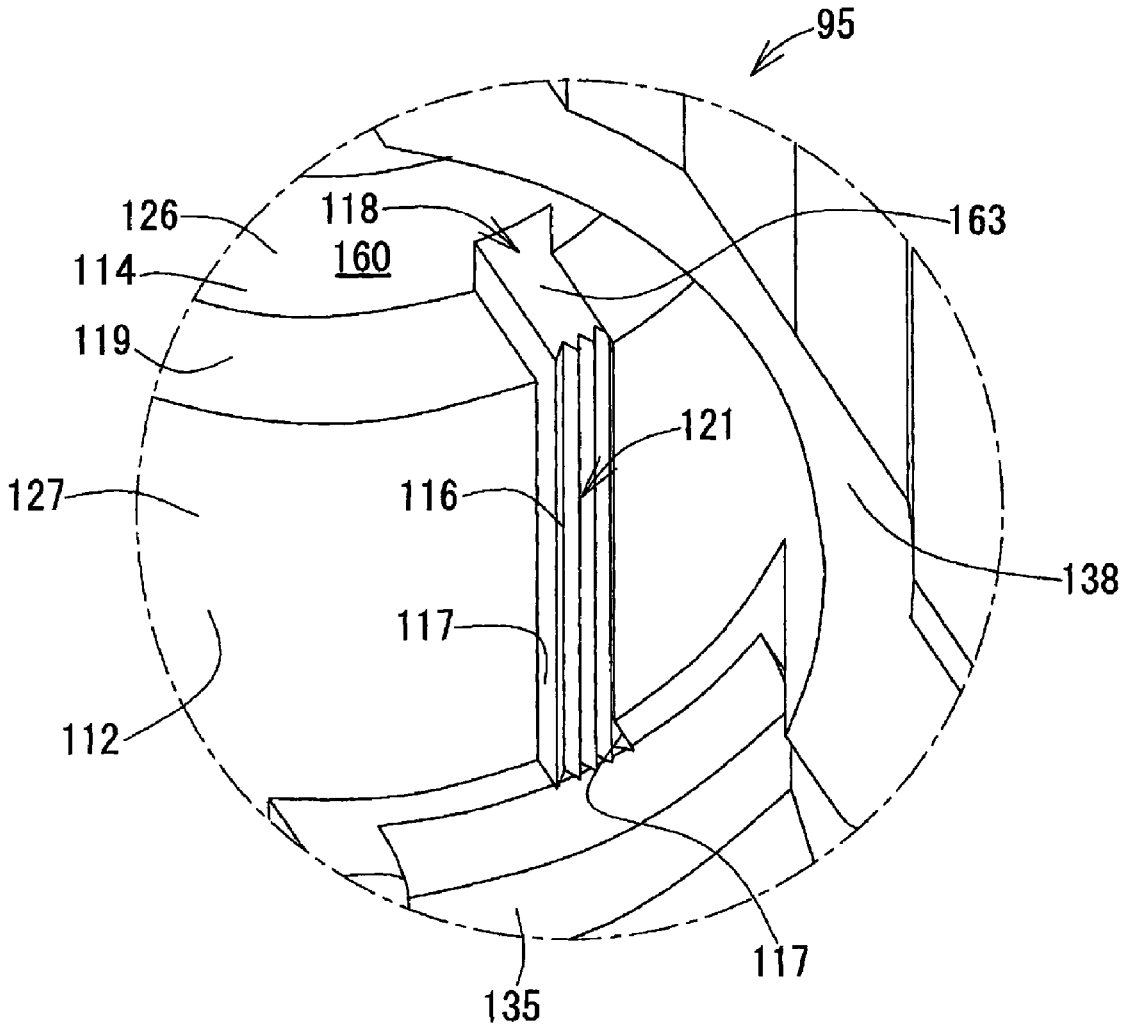
FIG. 11 is an enlarged view of a portion XI of the cap shown in FIG. 8(B).

Referring to FIGS. 8, 10 and 11, two first grooves 118 may be formed in inner surface 112 of second side wall 127 of cap 95. Each of first grooves 118 may extend in the axial direction of cap body 113, e.g., the direction parallel to depth direction 57. Each of first grooves 118 may be recessed from inner surface 112 of cap 95 in the radial direction of cap body 113, e.g., the direction perpendicular to depth direction 57. Each of first grooves 118 may be defined by two side surfaces 117 and a bottom surface 116 which intersects side surfaces 117, such that a cross section of first groove 118 taken along a plane which is perpendicular to the axial direction of cap body 113 has a substantially rectangular shape.

Moreover, a cross section of first groove 118 may have an L-shape extending along the axial direction of the cap body 113 in inner surface 112 of second side wall 127, when the cross section of first groove 118 is taken along a plane parallel to the axial direction of cap body 113. The cross section of first groove 118 further may extend inward toward the center of cap body 113 along an inner surface 119 of first side wall 126. Inner surface 119 of first side wall 126 may be positioned between sealing member 93 and end wall 125, and may contact and press sealing member 93. Referring to FIGS. 5 and 10, each of first grooves 118 may extend from a first covering portion 65 of inner surface 112 of second side wall 127 to opening 111 via a second covering portion 66 of inner surface 112 of second side wall 127. First covering portion 65 further may be configured to cover outer surface 63 of ink supply wall 99. Second covering portion 66 similarly may be configured to cover outer surface 76 of sealing member 93.

Referring to FIGS. 5, 8, and 10, two first grooves 118 may be formed in inner surface 112 of second side wall 127 and inner surface 119 of first side wall 126. Two first grooves 118 may be positioned at inner surface 112 at positions corresponding to the engaging members 115, respectively. That is, first grooves 118 may be positioned on the opposite side of second side wall 127 from engaging members 115, respectively. One of first grooves 118 may be positioned between ink supply wall 99 and a plane on which top face 103 lies, and the other one of first grooves 118 may be positioned between ink supply wall 99 and a plane on which bottom face 104 lies. Therefore, when ink cartridge 10 is mounted to the mounting portion, one of first grooves 118 may be positioned above ink supply wall 99, and the other one of first grooves 118 may be positioned below ink supply wall 99.

Referring to FIGS. 5 and 9, sealing member 93 may be positioned between end 155 of ink supply wall 99 and inner surface 119 of first side wall 126. Opening 111 may comprise an ink holding portion 160 formed between sealing member 93 and an inner surface 128 of end wall 125 inside first side wall 126. Ink holding portion 160 may be configured to temporarily hold ink which has leaked from ink supply opening 91. This may prevent ink from flowing out of cap 95. First groove 118 may extend to ink holding portion 160, such that first groove 118 is continuous with ink holding portion 160.

Figure 8B:
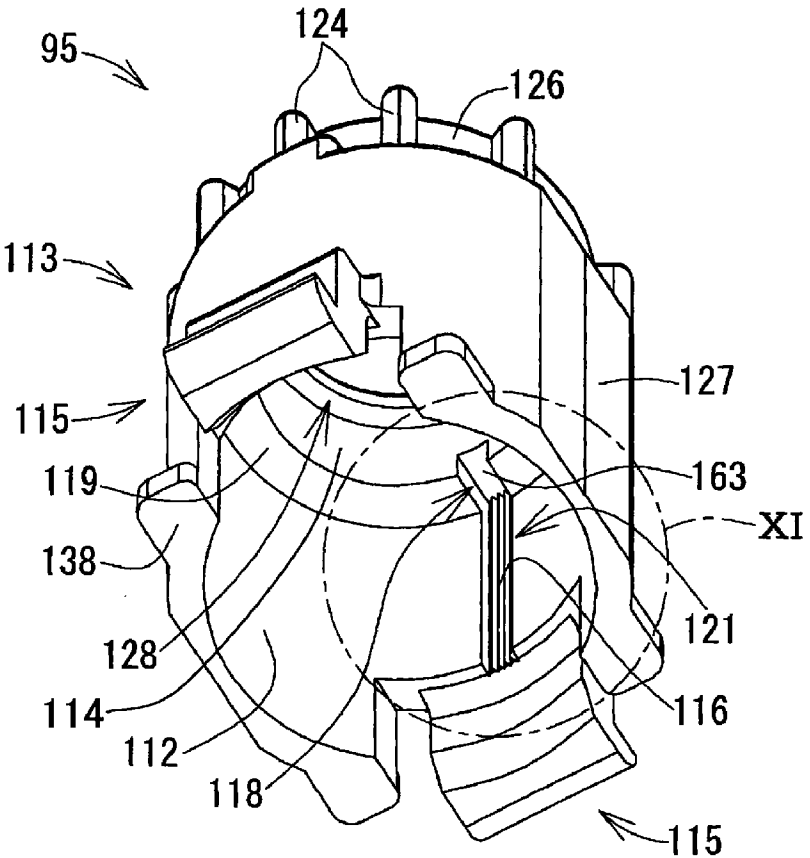
FIGS. 8(A) and 8(B) are perspective views of a cap seen in different angles, according to an embodiment of the invention.
Figure 8A:
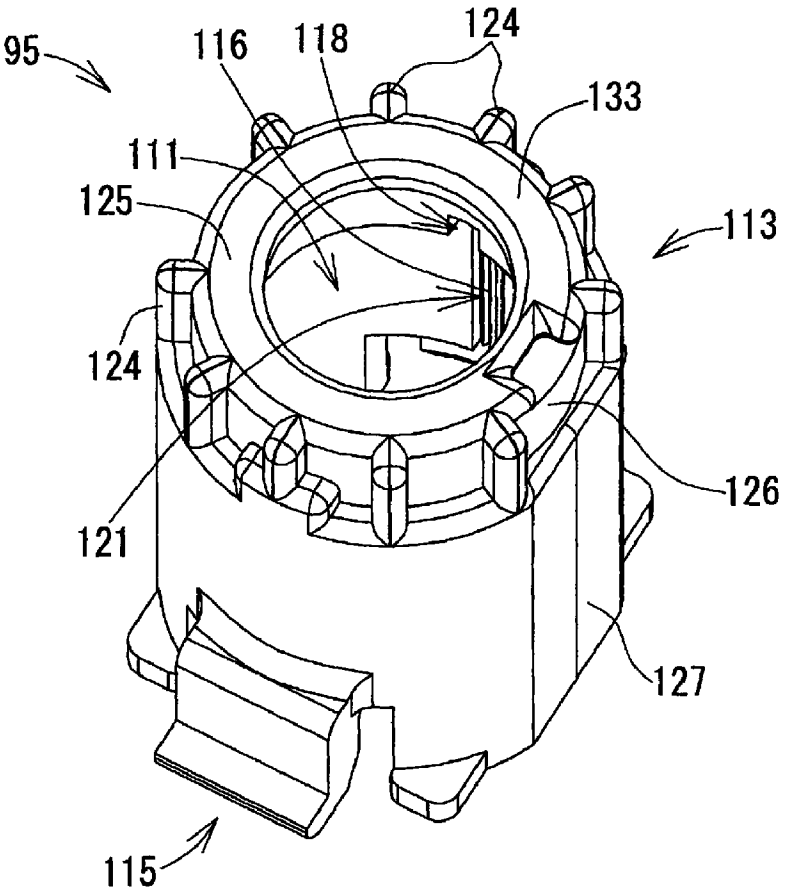

Referring to FIGS. 8(B), 10, and 11, a plurality of, e.g., five, second grooves 121 may be formed in bottom surface 116 of a portion of each of first grooves 118 formed in inner surface 112. Each of second grooves 121 may extend in the axial direction of cap body 113. Second grooves 121 may be recessed from bottom surface 116 of first groove 118 in the radial direction of cap body 113. A cross section of one of second grooves 121, taken along a plane which is perpendicular to the axial direction of cap body 113, may be substantially V-shaped. The inner space of each second groove 121 may be narrower than the inner space of first groove 118. Second grooves 121 may be sequentially aligned in the circumferential direction of cap body 113, and may extend in the axial direction of cap body 113, and may extend over first covering portion 65 and second covering portion 66.

In an embodiment, the second grooves 121 may not be formed in a portion of first groove 118 formed in inner surface 119. In another embodiment, second grooves 121 may be formed in bottom surface 116 of the portion of first groove 118 formed in inner surface 119. In yet another embodiment, only one second groove 121 may be formed in bottom surface 116 of first groove 118, or more than five second grooves 121 may be formed in bottom surface 116 of first groove 118. In still another embodiment, the cross section of second groove 121 may have a substantially rectangular shape. In still a further embodiment, second grooves 121 may be formed side surfaces 117 of first groove 118.

Referring to FIGS. 1(A) to 2(B), when first cover 21 is in the first position, cap 95 may be positioned in the interior of first cover 21 as shown in FIGS. 1(B) and 2(B). When first cover 21 moves from the first position to the second position, cap 95 may pass through opening 19, and when first cover 21 is in the second position, cap 95 may be positioned in the exterior of first cover 21 as shown in FIGS. 1(A) and 2(A). The diameter of opening 19 may be greater than the outer diameter of second side wall 127 of cap 95.

Referring to FIG. 4, case 20 may comprise air communication wall 199 extending from a portion of front face 102 which is positioned closer to top face 103 than to bottom face 104. Communication wall 199 may extend toward the exterior of case 20 in depth direction 57. In an embodiment, air communication wall 199 may have a substantially tube shape, e.g., a substantially circular, cylindrical tube shape. Valve chamber 55 may be formed in air communication wall 199, and valve chamber 55 may extend from the interior of air communication wall 199 to the interior of case 20 beyond front face 102 in depth direction 57. In an embodiment, valve chamber 55 may have a substantially circular, cylindrical shape. Valve chamber 55 may be configured to be in fluid communication with ink chamber 100. At least a portion of air communication valve mechanism 80 may be accommodated in valve chamber 55.

An opening 82 may be formed at an end of air communication wall 199. Air communication valve mechanism 80 may be configured to selectively place the interior of ink chamber 100 and the exterior of case 20 in fluid communication via opening 82 and valve chamber 55. Air communication valve mechanism 80 may comprise a coil spring 86, a valve element 87, a sealing member 83, and a cap 85. Each of coil spring 86, valve element 87, sealing member 83, and cap 85 may comprise a resin, e.g., polyacetal or silicon rubber.

Coil spring 86, valve element 87, sealing member 83, and cap 85 may be sequentially aligned in the listed order in depth direction 53, and may contact each other. Coil spring 86 and valve element 87 may be accommodated in valve chamber 55. Sealing member 83 and cap 85 may be positioned at a portion of air communication wall 199 defining opening 82. Valve element 87 may be configured to move in depth direction 57. Valve element 87 may comprise a lid member 88 and a rod 84. Rod 84 may extend form the center of lid member 88 to the exterior of case 20 via opening 82. Cap 85 may be attached to front face 102, such that sealing member 83 is positioned between cap 85 and the portion of air communication wall 199 that defines opening 82. Each of cap 85 and sealing member 83 may have an opening formed therethrough. Rod 84 also may extend through the openings of cap 85 and sealing member 83.

Coil spring 86 may be configured to apply a biasing force to valve element 87 toward sealing member 83. Therefore, lid member 88 may contact sealing member 83 and may cover the opening of sealing member 83, such that fluid communication between the interior of ink chamber 100 and the exterior of case 20 via opening 82 and valve chamber 55 is prevented. When an external force is applied to rod 84 against the biasing force of coil spring 86, rod 84 may move toward valve chamber 55. Accordingly, lid member 88 of valve element 87 may move away from sealing member 83, and the opening of sealing member 83 may be uncovered. Consequently, the interior of ink chamber 100 and the exterior of case 20 may be placed in fluid communication via opening 82 and valve chamber 55. When the interior of ink chamber 100 and the exterior of case 20 are in fluid communication, air may flow into ink chamber 100 via opening 82 and valve chamber 55. This may cause the pressure in ink chamber 100 to become equal to the atmospheric pressure.

Referring to FIGS. 1(A) to 2(B), when first cover 21 is in the first position, rod 84 may be positioned in the interior of first cover 21, away from front wall 161. When first cover 21 moves from the first position to the second position, rod 84 may contact front wall 161 and may be pressed toward valve chamber 55. When first cover 21 is in the second position, that lid member 88 of valve element 87 may be positioned away from sealing member 83, and the opening of sealing member 83 may be uncovered.

When ink cartridge 10 is inserted into the mounting portion, first cover 21 may contact a portion of the mounting portion and may be pressed against the portion of the mounting portion, such that first cover 21 moves from the first position to the second position. When this occurs, rod 84 may be pressed by first cover 21, such that lid member 88 of valve element 87 moves away from sealing member 83, and the opening of sealing member 83 is uncovered. Consequently, the interior of ink chamber 100 and the exterior of case 20 may be placed in fluid communication via opening 82 and valve chamber 55. Moreover, referring to FIG. 7, cap 95 may move from the interior of first cover 21 to the exterior of first cover 21, and an ink tube 49 positioned in the mounting portion may be inserted into opening 111 of cap 95. The outer diameter of ink tube 49 may be less than each of the diameter of a portion of opening 111 defined by end wall 125 and the diameter of a portion of opening 111 defined by inner surface 114 of first side wall 126.

When ink cartridge 10 is further inserted into the mounting portion, ink tube 49 may be inserted into ink supply opening 91, and an end of ink tube 49 may contact second valve element 97. The diameter of ink tube 49 may be greater than the diameter of the portion of ink supply opening 91 having the smallest diameter. Therefore, when ink tube 49 is inserted into ink supply opening 91, sealing member 93 may elastically deform and contact the outer surface of ink tube 49, to form a liquid-tight seal. When ink cartridge 10 is further inserted into the mounting portion, second valve element 97 may be pressed by ink tube 49 against the biasing force of coil spring 96, and may move away from sealing member 93. Accordingly, ink supply opening 91 is uncovered. When this occurs, ink tube 49 may place valve chamber 54 in fluid communication with the exterior of case 20 via ink supply opening 91 and opening 110, such that ink in the ink chamber 100 may be supplied to the recording head via an ink path 120 extending via opening 28, opening 41, the opening of valve element receiving portion 39, valve chamber 54, and ink tube 49.

When ink cartridge 10 is inserted into and removed from the mounting portion, ink may leak from ink supply opening 91. The ink which leaks from ink supply opening 91 temporarily may be held in ink holding portion 160, inside cap 95. As shown in FIG. 11, because first grooves 118 may extend to ink holding portion 160, the ink held in ink holding portion 160 may be drawn into an ink introducing portion 163 of first groove 118 by capillary action. Ink introduction portion 163 may be a portion of first groove 118 formed in inner surface 119 of first side wall 126. Such ink may be further drawn into second grooves 121, and the ink may reach first covering portion 65 via second covering portion 66 by capillary action. Accordingly, ink may be prevented from dropping out of cap 95 as an ink droplet.

Because first groove 118 extends from first covering portion 65 to opening 111 via second covering portion 66, even when sealing member 93 is in tight contact with inner surface 112 of cap 95, ink may be guided along first groove 118 toward case 20 beyond sealing member 93. Ink which has leaked from ink supply opening 91 may tend to flow downward, due to the gravitational force acting on the ink. Because one of first grooves 118 is positioned below ink supply wall 99, such ink efficiently may be drawn into first groove 118. Further, when first cover 21 is in the first position, cap 95 may be positioned in the interior of first cover 21. Therefore, even if ink should flow out of cap 95, ink may be held inside first cover 21.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An ink cartridge comprising:

a case comprising:

an ink chamber configured to store ink therein;

a particular face that faces an exterior of the case and has a first opening formed therethrough; and a particular wall comprising a particular chamber formed therein, wherein the particular wall extends from a particular portion of the particular face, and the particular portion surrounds the first opening, wherein the particular wall is configured to supply ink from the ink chamber to the exterior of the case via the particular chamber; and a cap having a second opening formed therethrough, wherein the cap comprises:

a particular inner surface covering an outer surface of the particular wall; and a particular groove formed in the particular inner surface of the cap and extending to the second opening, wherein the particular chamber is configured to be in fluid communication with the exterior of the case via the second opening.

2. The ink cartridge of claim 1, wherein the particular wall extends from the particular portion in a particular direction, and the particular chamber and the second opening are aligned in the particular direction.

3. The ink cartridge of claim 1, wherein the cap further comprises at least one further groove formed in a surface of the particular groove, and the particular groove and the further groove extend in a particular direction.

4. The ink cartridge of claim 1, wherein the particular wall extends from the particular portion in a particular direction, and the particular groove extends in the particular direction.

5. The ink cartridge of claim 1, further comprising a further wall positioned at an end of the particular wall opposite the first opening, wherein the further wall has a third opening formed therethrough, and the particular chamber is configured to be in fluid communication with the exterior of the case via the second opening and the third opening.

6. The ink cartridge of claim 5, wherein the particular wall extends from the portion of the particular face in a particular direction, and the particular chamber, the second opening, and the third opening are aligned in the particular direction.

7. The ink cartridge of claim 5, wherein the further wall comprises an elastic member having the third opening formed therethrough, wherein the particular inner surface of the cap comprises:

a first covering portion covering the outer surface of the particular wall; and a second covering portion covering an outer surface of the elastic member, wherein the particular groove is formed in the first covering portion and the second covering portion.

8. The ink cartridge of claim 7, wherein the second opening comprises a particular portion positioned between the elastic material and a further inner wall of the cap, wherein the particular groove extends to the particular portion of the second opening.

9. The ink cartridge of claim 1, further comprising:

a cover configured to cover a portion of the case, wherein the cover comprises a cover wall facing the particular face, and the cover wall has a cover opening formed therethrough; and at least one biasing member positioned between the cover wall and the particular face, wherein the cover is configured to move between a first position and a second position, and the cover wall is positioned closer to the particular face when the cover is in the second position than when the cover is in the first position, wherein the cap is positioned in an interior of the cover when the cover is in the first position and the cap is positioned in an exterior of the cover when the cover is in the second position, and the at least one biasing member is configured to bias the cover into the first position.

10. An ink cartridge comprising:

a case comprising:

an ink chamber configured to store ink therein;

a first face facing an exterior of the case and having a first opening formed therethrough;

a second face facing the exterior of the case and positioned opposite the first face;

a third face facing the exterior of the case and extending between the first face and the second face;

a fourth face facing the exterior of the case and extending between the first face and the second face, wherein the fourth face is positioned opposite the third face, and the first opening is positioned closer to the fourth face than to the third face; and a particular wall having a particular chamber formed therein, wherein the particular wall extends from a particular portion of the particular face, and the particular portion surrounds the first opening, wherein the particular wall is configured to supply ink from the ink chamber to the exterior of the case via the particular chamber; and a cap comprising:

a particular inner surface covering an outer surface of the particular wall; and a particular groove formed in the particular inner surface of the cap, wherein the cap has a second opening formed therethrough, and the particular chamber is configured to be in fluid communication with the exterior of the case via the second opening, wherein the particular groove extends to the second opening, and the particular groove is positioned between the particular wall and a plane on which the fourth face lies.

11. An ink supply system comprising:

a particular tube; and an ink cartridge comprising:

a case comprising:

an ink chamber configured to store ink therein;

a particular face that faces an exterior of the case and has a first opening formed therethrough; and a particular wall comprising a particular chamber formed therein, wherein the particular wall extends from a particular portion of the particular face, and the particular portion surrounds the first opening, wherein the particular wall is configured to supply ink from the ink chamber to the exterior of the case via the particular chamber;

a cap having a second opening formed therethrough, the cap comprising:

a particular inner surface covering an outer surface of the particular wall; and a particular groove formed in the particular inner surface of the cap, and extending to the second opening, wherein the particular chamber is configured to be in fluid communication with the exterior of the case via the second opening; and an elastic member positioned at an end of the particular wall opposite the first opening, wherein the elastic member has a third opening formed therethrough, and the particular chamber is configured to be in fluid communication with the exterior of the case via the second opening and the third opening, wherein the particular tube is configured to be inserted into the second opening and the third opening, and an outer diameter of the particular tube is less than a diameter of the second opening, and the outer diameter of the particular tube is greater than a diameter of the third opening.

12. The ink supply system of claim 11, wherein the particular wall extends from the particular portion in a particular direction, and the particular chamber, the second opening, and the third opening are sequentially aligned in the particular direction.

* * * * *